US005381710A

United States Patent [19]

Baker

[11] Patent Number: 5,381,710

[45] **Date of Patent: * Jan. 17, 1995**

[54] WRENCH WITH INCLINED DRIVE FACES

[76] Inventor: David R. Baker, 7454 Laurie Dr., Fort Worth, Tex. 76112

[ * ] Notice: The portion of the term of this patent subsequent to Aug. 31, 2010 has been disclaimed.

[21] Appl. No.: 112,672

[22] Filed: Aug. 26, 1993

Related U.S. Application Data

[60] Division of Ser. No. 791,024, Nov. 12, 1991, Pat. No. 5,239,899, which is a continuation-in-part of Ser. No. 657,139, Feb. 15, 1991, abandoned.

[51] Int. Cl.[6] ..... B25B 13/00

[52] U.S. Cl. ..... 81/186; 81/119

[58] Field of Search ..... 81/119, 186

[56] References Cited

U.S. PATENT DOCUMENTS 1,434,753 11/1922 Shackford .
2,671,368 3/1954 Diebold ..... 81/119
2,685,219 8/1954 Diebold .
3,000,245 9/1961 Orr .
3,242,775 3/1966 Hinkle .
4,214,491 7/1980 Martinmaas .
4,787,277 11/1988 Myers .
4,833,949 5/1989 Piperkovski .
4,848,193 7/1989 Wylie, III .
5,018,412 5/1991 Wylie, III .

*Primary Examiner*—James G. Smith
*Attorney, Agent, or Firm*—James E. Bradley

[57] ABSTRACT

A wrench for driving a nut utilizes curved drive faces. The drive faces are convex and protrude inward toward a center line between the jaw portions. Notches are formed on each drive face near the free end. One wrench is adjustable, having a positioner that pushes the nut outward as the movable jaw closes. The positioner maintains the nut in a position in contact with the curved drive surfaces.

6 Claims, 3 Drawing Sheets

WRENCH WITH INCLINED DRIVE FACES

CROSS REFERENCE TO RELATED APPLICATION

This application is a division, of application Ser. No. 07/791,024, filed on Nov. 12, 1991, now U.S. Pat. No. 5,239,899, which was a continuation-in-part of application Ser. No. 657,139, filed Feb. 15, 1991, now abandoned, David R. Baker, entitled "Open End Wrench".

BACKGROUND OF THE INVENTION

1. Field of the invention

This invention relates in general to wrenches, and in particular to a wrench having improved driving action.

2. Description of the Prior Art

In a conventional wrench, whether open end or adjustable, the jaws have parallel faces which slide over the sides of the nut. The faces are straight, flat surfaces.

A clearance is provided between the faces of the jaw and the nut. This clearance is necessary in order to be able to easily slide the jaw over the nut. Also, tolerances for manufacturing must be provided.

As a result, when the user applies torque, the jaw will first rotate a few degrees relative to the nut. This places the drive faces in contact with the corners of the nut. Basically, the drive will be on a single point contact on each jaw portion. Very little surface area of the sides of the nuts will be in contact with the jaw faces. As a result, if the nut is very tight, there is a tendency for the wrench to deform the metal of the nut, rounding the corners.

The drive point on one of the jaws will be close to the free end of the jaw because of the single point contact with the nut. This creates a long moment arm above the shank of the wrench. This long moment arm requires heavy jaw portions in order to prevent bending of the jaws under high torque.

Adjustable wrenches require that the user tighten the movable jaw on the nut each time the wrench is placed on the nut. Then, to remove the wrench at the end of a stroke, the user normally has to loosen the movable jaw. The user has to retighten the wrench at the beginning of the next stroke. Also, often the adjusting worm gear will tend to loosen as the wrench is used.

Adjustable open-end wrenches of traditional design are not recommended for driving in a reverse direction. This is the result of excessive stress being placed on the adjusting screw threads during reverse drive mode, causing warping and breaking of the adjusting screw.

In action, the nut acts as a rotating wedge between the upper and lower jaws of the wrench. The jaw spreading force thus imparted to the wrench finds the weakest part of this design, which is the adjusting screw which holds the movable lower jaw in position.

In forward driving direction, the jaw spreading force against the lower movable jaw is at the forward, lower nut corner. This force acts through a long moment arm. The force pivots the jaw slide rack on the adjusting screw threads and twists the jaw slide, partially locking it in its channel by drag force. Enough of the jaw spreading force is then carried by the wrench body in this way to permit safe forward drive without damage to the adjusting screw threads.

This is not so in reverse drive direction. In reverse drive, the jaw spreading force is exerted on the lower jaw at a point of rearward nut corner contact. The force is very close to and parallel to the jaw post as it tends to slide down and out of its channel. The force is at 90 degrees to the adjusting screw threads and the short moment arm through which it acts is insufficient to twist lock the jaw post in its channel. The result is that almost none of the nut imparted jaw spreading force is transmitted to the wrench body and must be borne by the adjusting screw threads.

The traditional method of dealing with this problem has been to attach the wrench handle at a 20 degree or more angle to the driven nut's centerline. This makes the flopping of this type wrench for 30 degrees drive stroke increments impossible and reverse driving of the nut impractical. Also, if attempted to be used for reverse drive, the force is still transmitted to the adjusting screw threads.

SUMMARY OF THE INVENTION

In this invention, a main drive face is located on each of the jaw portions. Each of the main drive faces is a convex curve protruding toward the center line. A nose drive face is formed on the free end of each jaw. A notch locates between the nose drive face and the main drive face. The notch may engage a corner of the nut when the wrench is in a main drive position and is pulled away from the nut.

Each of the main drive faces has a midpoint located equidistant between its forward and rearward ends. The midpoint on each jaw portion is spaced from the jaw center line at least as close as the distance from the nose drive face of the same jaw portion to the center line. This allows the nut to slide into the jaw portions.

In one embodiment, the wrench is an open end fixed dimension wrench. In another embodiment, the wrench is adjustable. One of the jaws will move toward the other of the jaws. The movable jaw moves at an angle of 105 degrees relative to the jaw center line, rather than 90 degrees as in the prior art type. A positioner member is mounted in the jaw of the adjustable wrench for contact with a nut. The positioner member is linked to the movable jaw so that it will advance forward when the movable jaw moves toward the fixed jaw. The positioner member maintains the nut in a proper position between the jaws regardless of nut size.

DETAILED DESCRIPTION OF THE INVENTION

Figure 1:
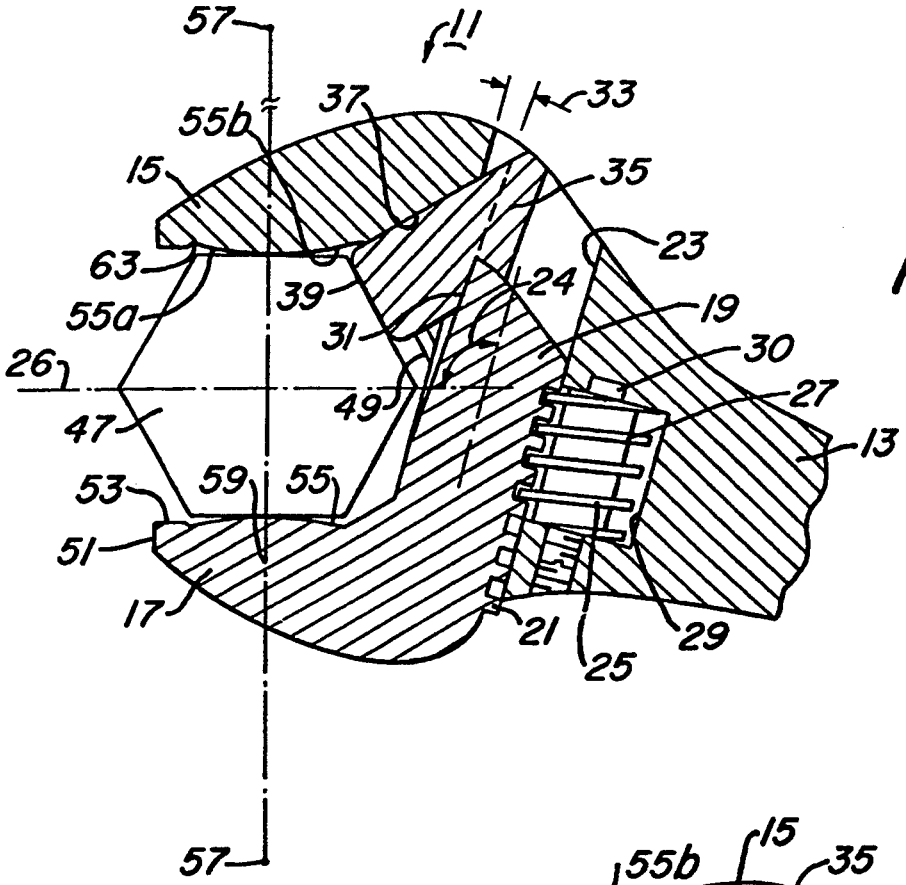
FIG. 1 is a vertical cross sectional view of an adjustable wrench constructed in accordance with this invention.

Referring to FIG. 1, adjustable wrench 11 has a shank 13 and a stationary jaw 15 rigidly formed with shank 13. A movable jaw 17 can move between open and closed positions as can be seen by comparing FIGS. 1 and 2. A jaw post 19 rigidly formed with movable jaw 17 has rack teeth 21. Post 19 extends through a hole 23 that is at the junction between the shank 13 and the jaws 15, 17. Hole 23 has an axis that inclines rearward and is at an angle 24 of 105 degrees relative to a jaw center line 26. Jaw center line 26 is a line equidistant between and generally parallel to the jaws 15, 17.

An adjusting screw or worm gear 25 having helical grooves 27 mounts rotatably in a recess 29 on worm gear post 30. The grooves 27 engage the teeth 21. In a conventional manner, rotating worm gear 25 will cause the movable jaw 17 to move closer to and farther from the stationary jaw 15. A wedge surface 31 is formed on the forward edge of post 19. Wedge surface 31 is at an angle 33 of about five degrees relative to the axis of hole 23.

Figure 5:
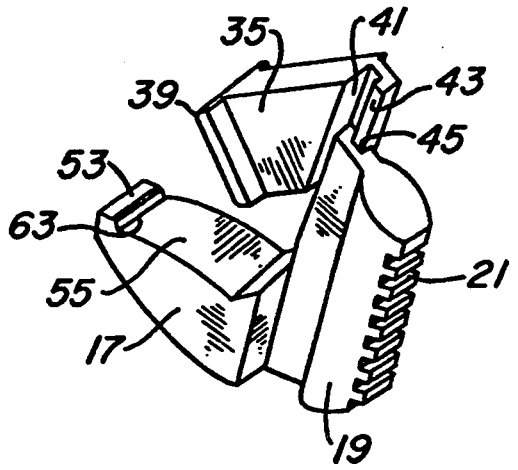
FIG. 5 is a perspective view of the movable jaw and positioning member of the wrench of FIG. 1.

A positioner member 35 locates in a cavity 37 that intersects hole 23. Cavity 37 has an axis that extends forward and downward, intersecting jaw center line 26 at an acute angle of about 30 degrees. Positioner member 35 has a face 39 that is flat and perpendicular to the axis of cavity 37. Positioner member 35 has a wedge surface 41 formed on its rearward edge, shown in FIG. 5. The rack wedge surface 31 slides relative to the wedge surface 41. An upward movement of rack 19 causes the positioner member 35 to move forward and downward. Downward movement of rack 19 causes the positioner member 35 to move upward and rearward.

Positioner member 35 has a straight tongue 43 on its rearward edge, located rearward of wedge surface 41. Tongue 43 locates in a groove 45 in rack 19. Tongue 43 and groove 45 retain positioner member 35 with rack 19.

Figure 2:
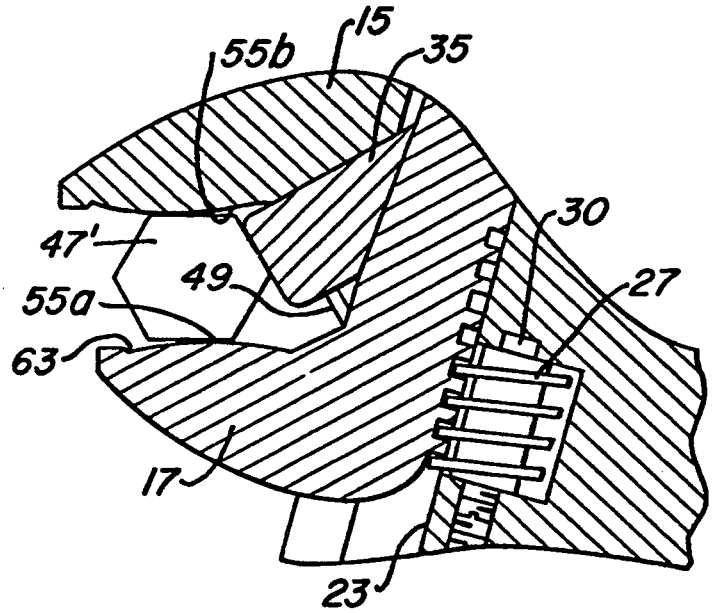
FIG. 2 is a cross sectional view of the wrench of FIG. 1, showing the wrench engaging a smaller nut than the nut in FIG. 1.
Figure 4:
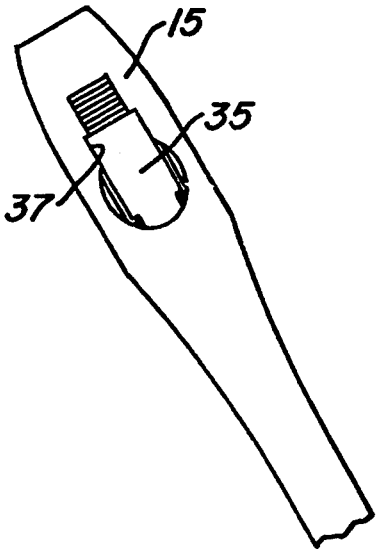
FIG. 4 is a top view of the wrench of FIG. 1.
Figure 3:
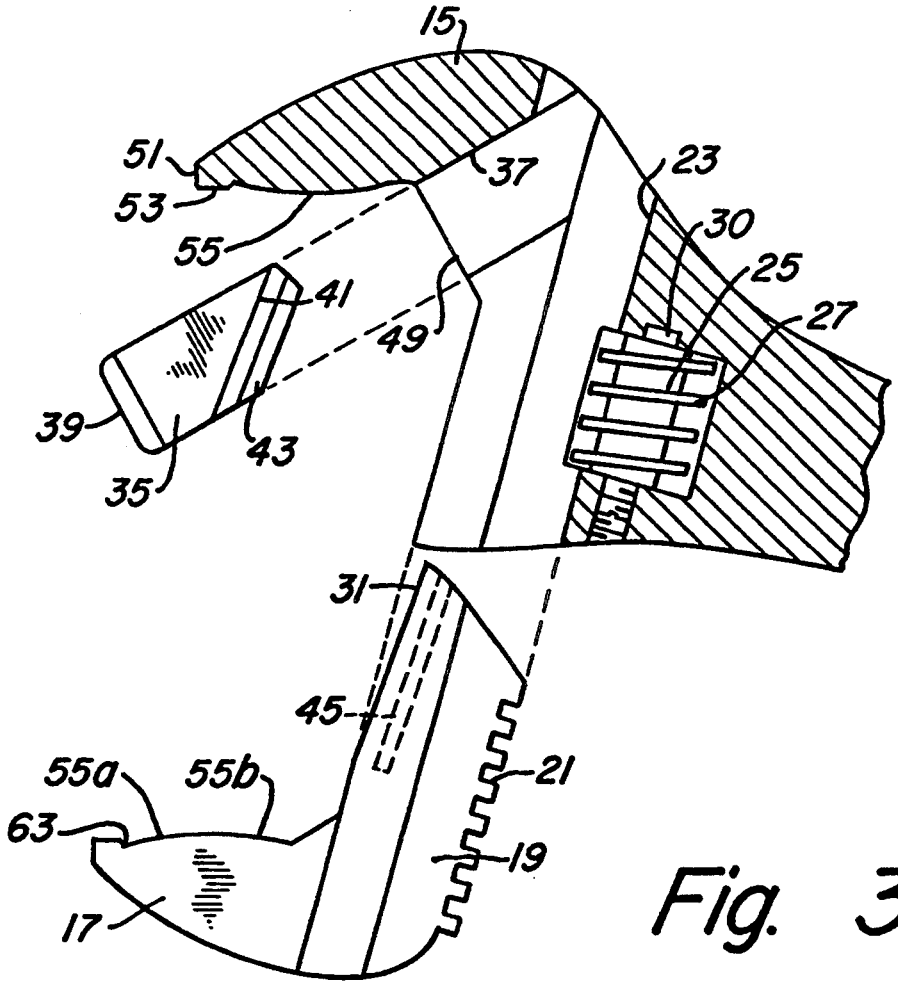
FIG. 3 is an exploded, partially sectioned view of the wrench of FIG. 1.

The flat face 39 is oriented so that it will mate generally flush with a side of a nut 47 when the wrench 11 is inserted over the nut 47. The face 39 will be substantially flush with a rear stop 49 located between jaws 15, 17 when the movable jaw 17 is in its widest position. As the movable jaw 17 moves toward stationary jaw 15, positioner member 35 moves forward and downward. The face 39 serves as a stop for nut 47. As illustrated in FIG. 2, with a smaller nut 47', the nut 47' will be located a considerable distance forward of the rear stop 49.

Each jaw 15, 17 has a free end 51. A nose drive face 53 is formed on each free end 51. Each nose drive face 53 is slightly curved and convex. Preferably, each is formed with a radius that is about the same diameter of the largest nut 47 for wrench 11. Because of the curvature, the nose drive faces 53 diverges outward, with a greater dimension between the nose drive faces 53 at the forward edges of the nose drive faces, than at the rearward edges of the nose drive faces.

A main drive face 55 is located on each jaw 15, 17, rearward of the nose drive face 53. Each main drive face 55 is preferably a convex curve having a forward portion 55*a*, a midpoint 59, and a rearward portion 55*b*. The radius for the portion at midpoint 59 is different in magnitude from the radius for the forward portion 55*a* and rearward portion 55*b*. Each radius point for the forward portion 55*a*, midpoint 59 and rearward portion 55*b* is located on a line passing through midpoint 59 perpendicular to center line 26. The radius point 57 for a central portion at each midpoint 59 is preferably located at a distance twice the diameter of the minimum size nut 47' (FIG. 2) for wrench 11. The radius for the forward and rearward portions 55*a*, 55*b* is preferably twice the diameter of the maximum size nut 47. The different radius dimensions accommodate nut 47 tolerance variations, and also allow for slight flexing of the jaws 15, 17 when under torque.

The forward portion 55*a* inclines toward the jaw center line 26 in a rearward direction. The two forward portions 55*a* thus converge toward each other in a rearward direction from nose drive face 53 rearward. The rearward portion 55*b* inclines away from center line 26, when measuring in a rearward direction. The rearward portions 55*b* thus diverge from each other when proceeding in a rearward direction from the forward portions 55*a*. Because of the fairly large radius of the main drive faces 55, the rearward portion 55*b* of the stationary jaw 15 will be approximately parallel with the forward portion 55*a* of the movable jaw 17.

Each midpoint 59 is the closest portion of the main drive face 55 to the center line 26. The distance from each midpoint 59 to center line 26 is preferably the same as the minimum distance from each nose drive face 53 to center line 26.

A notch 63 locates at the junction of the nose drive face 53 with the main drive face 55. Notch 63 is generally V-shaped, having curved flanks on each side. The curved flank on the rearward side is the forward termination of the main drive face 55. A corner of nut 47 may locate in the notch 63 on movable jaw 17 when the wrench 11 is rotated clockwise as shown in FIG. 1.

In the operation of the embodiment of FIGS. 1–5, the user will slide the jaws 15, 17 over nut 47. The user will rotate worm gear 25 until the midpoints 59 of the main drive faces 55 touch opposite sides of nut 47. As the user rotates worm gear 25 and as the movable jaw 17 closes, the positioner 35 will move forward and downward. The positioner face 39 will engage one of the sides of nut 47 in generally flush contact. The nut 47 will be spaced forward of the rear stop 49, unless the nut 47 is a maximum size for wrench 11. The positioner 35 positions the nut 47 with the center of nut 47 approximately aligned with the midpoints 59 of the main drive faces 55.

The user then rotates the wrench in a clockwise direction. When this occurs, if nut 47 is tight, the wrench 11 will rotate a few degrees relative to nut 47. A portion of one side of nut 47 will contact the forward portion 55*a* of main drive face 55 of the movable jaw 17. The opposite side of nut 47 will engage the rearward portion 55*b* of the stationary jaw 15. Torque will be applied to the opposite flat sides of nut 47, not to the corners. If the user pulls the wrench away from nut 47 inadvertently while driving the nut 47, the notch 63 will engage a corner of nut 47 to retain the wrench 11 on nut 47. The wrench 11 may be readily removed from nut 47 at the end of a stroke without loosening worm gear 25. The user need not retighten worm gear 25 when placing the wrench 11 back on the nut 47 for the next stroke.

When adjusting to a nut 47' of a smaller diameter, as shown in FIG. 2, the positioner 35 and angle 24 of movement of the movable jaw 17 will force the nut 47' farther outward from the rear stop 49 than with a larger nut 47. The wedge-surfaces 41, 31, are at an angle selected to cause the positioner member 35 to maintain a significant portion of the nut 47' in a good driving position. This good driving position requires that a significant portion of one side of nut 47′ be in contact with the forward portion 55*a* of movable jaw 17. A significant portion of the opposite side of nut 47′ should be in contact with rearward portion 55*b* of stationary jaw 15. The center of nut 47′ will be slightly forward of the midpoint 59 of main drive face 55 of movable jaw 17.

The notch 63 helps to retain the wrench 11 on the nut 47′, even if the nut 47′ initially is not touching notch 63, as shown in FIG. 2. If the user pulls the wrench 11 rearward relative to nut 47′ while applying torque, the notch 63 will catch the corner of the nut 47′ to retain the wrench 11 on nut 47′.

If access is a problem, the nose drive faces 53 can be used to drive the nut 47. Nut 47 will be located forward of the positions shown in FIGS. 1 and 2. The positioner member 35 will not touch the sides of the nut 47. Wrench 11 will also work with square nuts, as well as hexagonal.

Figure 6:
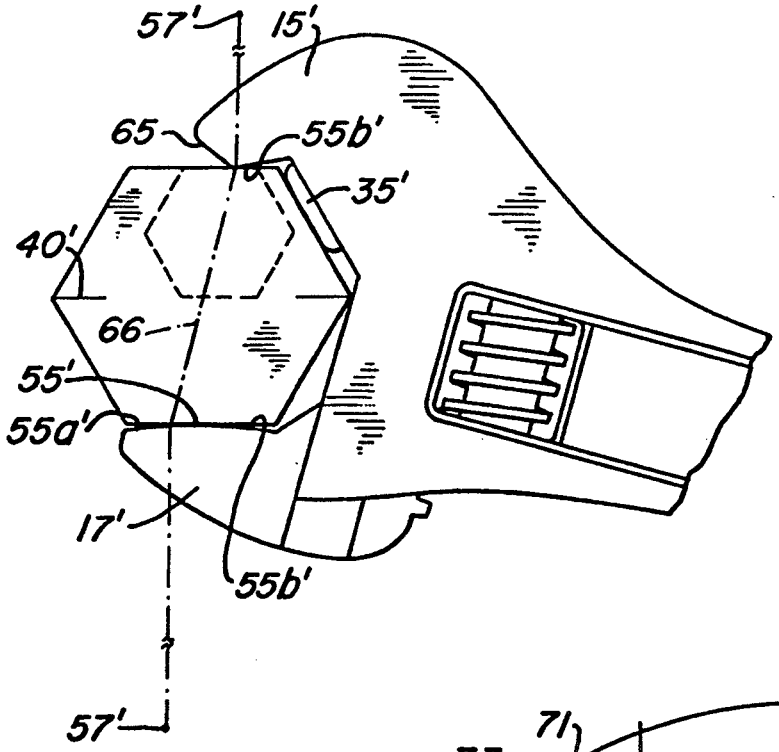
FIG. 6 is a side view of-an alternate embodiment of an adjustable wrench constructed in accordance with this invention.

In the embodiment of FIG. 6, free end 65 of stationary jaw 15′ is truncated. Stationary jaw 15′ terminates much shorter than stationary jaw 15 of the embodiment of FIGS. 1–5. The movable jaw 17′ also terminates at a shorter distance, although movable jaw 17′ does extend a greater distance than stationary jaw 15′. There is no notch 63 nor nose drive face 53 as in the embodiment of FIGS. 1–5. Because of the short length, the main drive face 55′ of the stationary jaw 15′ has only a rearward portion 55*b*′ and does not have a forward portion 55*a*.

The radius point 57′ for the drive face 55′ of stationary jaw 15′ is located rearward of the radius point 57 of the wrench 11 of FIGS. 1–5. The radius point 57′ for the forward portion 55*a* of drive face 55′ of the movable jaw 17′ is located forward of the radius point 57 for the wrench 11 of FIGS. 1–5. The radius point 57′ is on a line perpendicular to jaw center line 40′ and which passes through an intersection of a line 66 with main drive face 55′. Line 66 passes through the center line of the nut and is 75 degrees relative to center line 40′. The radius point 57′ for the stationary jaw 15′ is similar. The rearward portion 55*b*′ of the movable jaw 17′ is straight and on a line that is about 3½ to 4 degrees relative to jaw center line 40.

The embodiment of FIG. 6 is the same as the embodiment of FIGS. 1–5 in other respects. The positioner member 35′ works in the same manner. The shorter jaws 15′, 17′ enable the wrench to ratchet. That is, one may slide the wrench from one drive side of the nut to another without removing the wrench.

Figure 7:
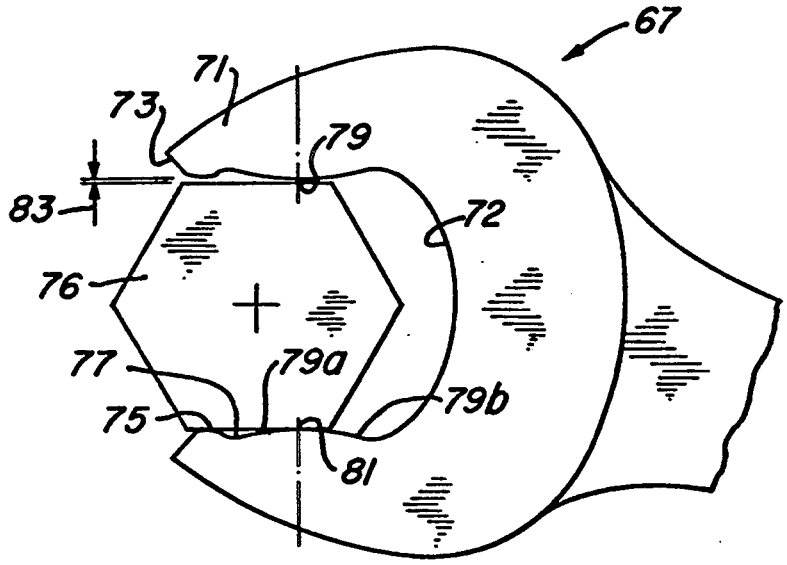
FIG. 7 is a side view of another alternate embodiment of the invention, showing a fixed open end wrench constructed in accordance with this invention.
Figure 8:
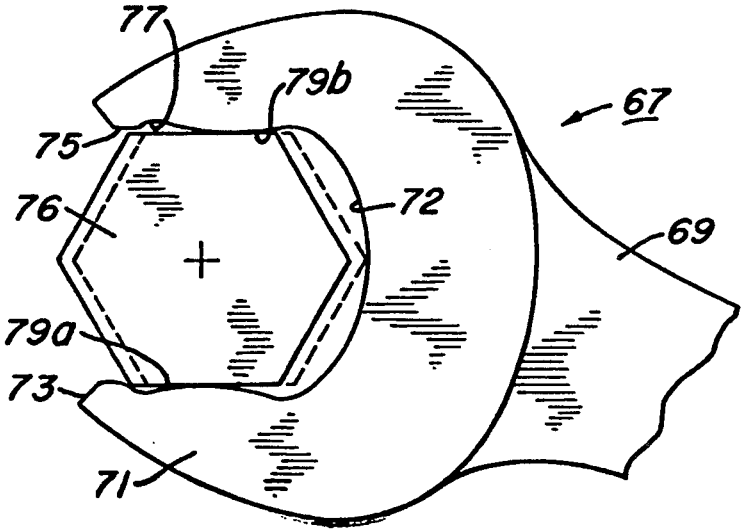
FIG. 8 is a side view of the wrench of FIG. 7, showing the wrench moved farther over the nut than in FIG. 7.

FIGS. 7–8 illustrate a fixed jaw wrench 67. Wrench 67 has a fixed jaw dimension. Wrench 67 has a shank 69 and two jaws 71. The jaws 71 join each other at the rearward ends by a stop face 72. Each jaw 71 terminates in a free end 73.

A nose drive face 75 locates adjacent each free end 73. Each nose drive face 75 is a segment of a curve. The radius of the curve is preferably equal to the diameter of nut 76. A notch 77 locates immediately rearward of each nose drive face 75. Notch 77 is generally in the shape of a "V", having curved flanks Notch 77 is forward of a curved main drive face 79.

Main drive face 79 is a convex curve having a forward portion 79*a*, a midpoint 81, and a rearward portion 79*b*. The forward portions 79*a* converge toward each other, when proceeding rearward. The rearward portions 79*b* of the two main drive faces 79 diverge from each other when proceeding rearward. The distance between midpoints 81 is only slightly greater than the distance between sides of nut 76 as indicated by the clearance 83. This distance is no greater and preferably the same as the minimum distance between the nose drive faces 75.

The radius of curvature of the main drive face 79 at the midpoint 91 is preferably two times the nut 76 diameter. The radius of curvature of the forward portion 79*a* and the rearward portion 79*b* is preferably about 1.5 times the nut 76 diameter. The radius points for the forward portion 79*a*, midpoint 81, and rearward portion 79*b* are on the same line, which is perpendicular to the jaw center line and passes through the midpoints 81. The different radius dimensions for the drive face portions 79*a*, 79*b* and 81 compensate for variations in the nut tolerances, compensate for slight flexing in the jaws 71, and provide added nut corner clearance when nut 76 slides-forward-under torque and is retained by notch 77.

In the operation of the embodiments of FIGS. 7 and 8, the user slides the wrench 67 over nut 76 until a corner contacts rear stop face 72, as illustrated by the dotted lines of FIG. 8. If the nut 76 is tight, rotating wrench 67 will result in the wrench 67 rotating a few degrees clockwise before applying torque to the nut 76. One side of nut 76 will locate on the forward portion 79*a* of one jaw 71. The opposite side of nut 76 will locate generally flush with the rearward portion 79*b* of the other jaw 71. If the user pulls the wrench away from nut 76 while applying torque, a corner of nut 76 will catch in one of the notches 77. The notch 77 serves to retain the wrench 67 on the nut 76 while applying torque.

The dotted lines in FIG. 7 illustrate a nose drive position. In that position, the nose drive faces 75 engage the flats of the nut 76 to drive the nut. The solid lines of FIG. 7 illustrate an intermediate drive position in which the wrench 67 has been pushed farther on the nut 76, but not so far as the main drive position of FIG. 8. In the intermediate drive position, the nose drive face 75 on one of the jaw portions, shown to be the lower jaw portion, contacts a forward portion of one of the flat sides of the nut 76. The main drive face 79 on the other or upper jaw portion contacts a rearward portion of another of the flat sides of the nut 76.

The invention has significant advantages. The arcuate, convex drive faces enable a significant portion of the sides of the nut to mate flush with drive surfaces. This additional surface of wrench to surface of nut contact over conventional wrenches eliminates driving the nut on its corners. This avoids marring the corners of the nut. The notch retains the nut under torque. The positioning member and the angle of travel of the movable jaw of the adjustable wrench maintain the nut in an appropriate position in the jaw for optimum drive. The curved drive faces and positioner member of the adjustable wrench avoid having to loosen the wrench at the end of each stroke to remove the wrench from the nut. The user does not have to retighten each time the wrench is placed back on the nut. Because of the angle of force-passing through the worm gear, the worm gear does not loosen while using the wrench.

The adjustable wrench is safely drivable in a 24 reverse direction. The 105 degree jaw slide angle, instead of the usual 90 degrees, places the jaw spreading force across the adjusting worm gear threads and forces the worm gear's guide post to bear some of the load while locking the worm gear in its adjusted position during power stroke. This 105 degree jaw post angle places the direction of force closer to a 90 degree angle relative to the jaw post rather than parallel to it. Plane driving of the nut, rather than corner drive, moves the reverse drive nut contact point of the adjustable wrench forward on the lower jaw, thus increasing the length of the moment arm through which it acts to twist-lock the jaw post in its channel. The additive effect of these design characteristics reduces the force applied to the jaw adjusting screw threads during reverse drive to a low enough level as to permit safe reverse driving. Additionally, they eliminate adjusting screw walk during drive, so a one-time adjustment is possible. The wrench handle of the adjustable wrench may now be attached at a 15 degree angle permitting 30 degree/30 degree driving of hex nuts and 60 degree/30 degree driving of square nuts as well as reverse driving the nut safely.

While the invention has been shown in only three of its forms, it should be apparent to those skilled in the art that it is not so limited, but is susceptible to various changes without departing from the scope of the invention.

I claim:

1. A wrench for driving a nut having a plurality of flat sides, comprising in combination:

a jaw joined to a shank and having jaw portions rigidly formed together and separated from each other by a center line of the jaw, each of the jaw portions having a free end;

a nose drive face located on the free end of each jaw portion for engaging flats of a nut when in a nose drive position, the distance between the nose drive faces being slightly greater than the distance between opposite flat sides of the nut;

a main drive face on each of the jaw portions, each of the main drive faces being a convex curve protruding toward the center line, each of the main drive faces having a forward end that joins a rearward end of one of the nose drive faces, defining a notch between the nose drive face and the main drive face, one of the notches adapted to engage a corner of the nut if the wrench is pulled away when in a main drive position to retain the wrench on the nut; and each of the main drive faces having a midpoint located equidistant between the forward end and a rearward end of each main drive face, the distance between midpoints of each main drive face being substantially the same as the distance between the nose drive faces of the each jaw portion, so that the wrench may be placed on a nut for the main drive position by sliding the wrench forward with the nut passing between the nose drive faces and locating between the main drive faces, and so that when the wrench is in an intermediate drive position between the main drive position and the nose drive position, the nose drive face on one of the jaw portions contacts a forward portion of one of the flat sides of the nut, and the main drive face on another of the jaw portions contacts a rearward portion of another of the flat sides of the nut.

2. The wrench according to claim 1 wherein the notch has a generally V-shaped configuration with curved flanks.

3. The wrench according to claim 1 wherein each of the main drive faces has a radius that is more than the diameter of the nut.

4. The wrench according to claim 1 wherein each of the nose drive faces is a convex curve.

5. The wrench according to claim 1 wherein each the main drive faces has a radius that is more than the diameter of the nut and each of the nose drive faces is an arcuate convex curve having a radius that is less than the radius of the main drive face.

6. A wrench for driving a nut having a plurality of flat sides, comprising in combination:

a jaw joined to a shank and having jaw portions rigidly formed together so as to be immovable relative to each other and separated from each other by a center line of the jaw, each of the jaw portions having a free end;

a nose drive face located on the free end of each jaw portion for engaging flats of a nut when in a nose drive position;

a main drive face on each of the jaw portions, each of the main drive faces being a convex curve protruding toward the center line, each of the main drive faces having a forward end that joins a rearward end of one of the nose drive faces, defining a notch between the nose drive face and the main drive face for engaging a corner of the nut to retain the wrench on the nut; and each of the main drive faces having a midpoint located equidistant between the forward end and a rearward end of each main drive face, the midpoint on each jaw portion being spaced from the center line substantially the same as the distance from the nose drive face of the same jaw portion to the center line, so that the wrench may be placed on a nut by sliding the wrench forward with the nut passing between the nose drive faces and locating between the main drive faces, and so that when the wrench is in an intermediate drive position in which the nut is only partially inserted into the wrench between the main drive position and nose drive position, the nose drive face on one of the jaw portions contacts a forward portion of one of the flat sides of the nut, and the main drive face on another of the jaw portions contacts a rearward portion of another of the flat sides of the nut.

* * * * *